US007541323B2

(12) United States Patent
Serobian

(10) Patent No.: US 7,541,323 B2
(45) **Date of Patent: *Jun. 2, 2009**

(54) SPRAYABLE DRY WASH AND WAX COMPOSITION AND METHOD OF USING SAME

(75) Inventor: Ashot Serobian, Martinez, CA (US)

(73) Assignee: The Clorox Company, Oakland, CA (US)

( * ) Notice: Subject to any disclaimer, the term of this patent is extended or adjusted under 35 U.S.C. 154(b) by 14 days.

This patent is subject to a terminal disclaimer.

(21) Appl. No.: 12/114,484

(22) Filed: May 2, 2008

(65) Prior Publication Data

US 2009/0035451 A1 Feb. 5, 2009

Related U.S. Application Data

(63) Continuation of application No. 11/833,478, filed on Aug. 3, 2007, now Pat. No. 7,399,738.

(51) Int. Cl.
*C11D 9/36* (2006.01)
*C11D 3/37* (2006.01)

(52) U.S. Cl. ..... 510/241; 510/180; 510/208; 510/242; 510/245; 510/268; 510/417; 510/434; 510/466; 510/477; 106/3; 106/287.1

(58) Field of Classification Search ..... 510/180, 510/208, 242, 245, 268, 417, 434, 466, 477; 106/3, 287.1
See application file for complete search history.

(56) References Cited

U.S. PATENT DOCUMENTS

| | | | | | |
|---|---|---|---|---|---|
| 3,914,197 | A | * | 10/1975 | Schoenholz et al. | 524/269 |
| 4,354,871 | A | * | 10/1982 | Sutton | 106/3 |
| 4,810,407 | A | * | 3/1989 | Sandvick | 510/400 |
| 4,963,432 | A | * | 10/1990 | Fuggini et al. | 442/165 |
| 5,017,222 | A | * | 5/1991 | Cifuentes et al. | 106/10 |
| 5,531,814 | A | * | 7/1996 | Bahr et al. | 106/3 |
| 5,681,377 | A | * | 10/1997 | Lohr et al. | 106/3 |
| 5,849,838 | A | * | 12/1998 | Barlow | 524/804 |
| 5,968,238 | A | * | 10/1999 | Healy et al. | 106/3 |
| 6,090,767 | A | | 7/2000 | Jackson et al. | |
| 6,159,551 | A | | 12/2000 | Yeiser et al. | |
| 6,165,479 | A | | 12/2000 | Wheeler | |
| 6,206,956 | B1 | | 3/2001 | Muntz et al. | |
| 6,221,433 | B1 | | 4/2001 | Muntz et al. | |
| 6,309,984 | B1 | | 10/2001 | Nonaka et al. | |
| 6,475,934 | B1 | | 11/2002 | Nonaka et al. | |
| 6,506,715 | B1 | * | 1/2003 | Schultz et al. | 510/189 |
| 7,067,573 | B1 | * | 6/2006 | Serobian | 524/269 |
| 2005/0143282 | A1 | * | 6/2005 | Creutz et al. | 512/4 |

FOREIGN PATENT DOCUMENTS

| | | |
|---|---|---|
| EP | 839876 | 5/1998 |
| JP | 10204382 | 4/1998 |
| JP | 11080668 | 3/1999 |

* cited by examiner

*Primary Examiner*—Charles I Boyer
(74) *Attorney, Agent, or Firm*—Erin Collins; Thomas Feix

(57) ABSTRACT

A composition for simultaneously cleaning and waxing non-porous surfaces without the need for additional rinsing of the treated surface with water, has a pH of from about 6 to about 7 and contains by weight: (a) from about 0.04 to about 0.12% of an acrylic-based polymer, wherein the acrylic-based polymer is a hydrophobically modified, crosslinked polyacrylate powder which has been crosslinked with a polyalkenyl polyether or is an acrylic polymer containing acid groups and which dissolves and swells immediately when neutralized with an alkali salt (b) from about 0.5 to about 5.0% of a silicone blend composed of: (i) from about 70 to about 95% of a first polydiorganosiloxane fluid having a viscosity of from about 0.65 to about 60,000 centistokes at 25° C., and (ii) from about 5 to about 30% of a polydiorganosiloxane fluid mixture having a viscosity of from about 500 to about 2000 centistokes at 25° C., the polydiorganosiloxane fluid mixture being composed of a second polydiorganosiloxane fluid and a silicone resin; (c) wax; and (d) water. The composition can be used to simultaneously clean and wax non-porous surfaces such as the exterior surfaces of automobiles and other vehicles, windows, and the like.

20 Claims, No Drawings

SPRAYABLE DRY WASH AND WAX COMPOSITION AND METHOD OF USING SAME

This application is a continuation of and claims priority to U.S. application Ser. No. 11/833,478, which was filed on Aug. 3, 2007 now U.S. Pat. No. 7,398,738.

BACKGROUND OF THE INVENTION

This invention relates to a composition formulated for simultaneously washing and waxing non-porous surfaces. More particularly, this invention relates to a sprayable composition formulated for both cleaning and waxing non-porous surfaces, including, but not limited to, exterior surfaces of automobiles and other vehicles, windows, and the like, without the need for additional running water.

The present invention also relates to a method for simultaneously cleaning and polishing a non-porous surface without the need for rinsing the surface with water wherein the method uses the composition of the invention. Waxes and polishes have been used for at least several hundred years for waxing and polishing surfaces such as floors, windows, furniture, and vehicle surfaces. Originally, most waxes were paste waxes which required that the surface first be cleaned of all dirt and oxidation. The wax was then applied by hand or with a buffering-like device to rub the wax into the surface. The rubbing or buffing sometimes caused swirling on the surface. The wax was allowed to dry and then it was rubbed or buffed off the surface. Preferably, the waxing was done on a clean, cool surface and not in direct sunlight. This application process is still used to some extent and is very labor-intensive and requires physical strength either to rub the wax on and buff it off, either by hand or with a mechanical buffing machine. In the 1950's, liquid waxes became available. Liquid waxes are easier to apply than paste wax since they can be poured onto an applicator, such as a cloth, sponge, reinforced paper, or other type of applicator, and then rubbed or buffed onto the surface. The rubbing can leave swirling on the surface. The wax is allowed to dry and then it is rubbed or buffed off. Liquid waxes are similarly applied. The liquid waxes are preferably applied to a clean, cool surface and the waxing is not done in direct sunlight. In the 1970's, spray devices became available, and waxes and polishes were developed that could be sprayed onto the surface.

One type of device was the finger trigger sprayer commonly used for household cleaners and the like. The sprayer has a pump actuated by the finger which draws fluid up from a reservoir and sprays the fluid out of a nozzle. Waxes and polishes applied by this method have many of the characteristics of liquid wax and polish. These types of applicators have not been very popular because the sprayers only spray a limited amount of fluid for each finger pull of the sprayer and accordingly, it takes time to spray large surface areas such as a car, airplane, or other large vehicle. In addition, it is very tiring and can be painful to actuate the finger trigger sprayer for long periods of time. The wax or polish is preferably applied to a clean, cool surface and not in direct sunlight. Once the wax is sprayed on the surface, it is rubbed onto the surface to cover the surface and allowed to dry. The rubbing can leave swirls on the surface. After it is dried, it is rubbed off or buffed off, as with paste wax and liquid wax. Similar to waxes, spray polishes were also developed, but they had the same problem as waxes because they could only be applied to clean surfaces. Unlike waxes, polishes normally do not have to be buffed. A recent variation of the liquid wax is the wipe-on and hose-off wax. This wax is sprayed on the surface and rubbed in, or poured onto an applicator or directly onto the surface and rubbed into the surface. The rubbing can leave swirls on the surface. Once the wax is dry, it is hosed off with a water spray from a garden hose. Following removal of the wax with the hose spray, the vehicle has to be dried off. With this method of waxing, the hosing-off step does not guarantee that all the wax residue will be removed from the vehicle. It has been found that the user of the wax normally has to go back over the vehicle with a water spray after drying it to remove residual wax and then dry the surface again.

In U.S. Pat. No. 6,506,715 to Schultz et al. and U.S. Pat. No. 5,968,238 to Healy et al., the invention is a wash and wax composition which can be used on a dirty automotive exterior surface to simultaneously wash and wax the surface, but it requires that the composition be used on a pre-wetted surface and that the treated surface is dried and then washed to remove soils and residue. The dry wash and wax formulation of the present invention may be used on a dry soiled surface and does not require additional drying or washing after application. In U.S. Pat. No. 6,159,551 to Yeiser et al, the wash and wax formulation requires the use of mineral spirits as a solvent and also requires the additional step of buffing the wax film to remove residue. Mineral spirit solvents are not desirable in wax formulations because they are not VOC exempt which means they fall under more strict EPA regulations. In U.S. Pat. No. 7,067,573 to Serobian, the formulation requires a hydrocarbon solvent, an abrasive and is substantially free of wax, unlike the present invention. In U.S. Pat. No. 6,090,767 to Jackson et al. the formulation is a wash and gloss formulation, but it does not contain a wax and does not impart long lasting hydrophobicity to the surface being treated.

In U.S. Pat. No. 6,475,934 to Nonaka et al. and U.S. Pat. No. 6,309,984 to Nonaka et al. the water repellant treatment formulation relies on the use of a wet wiping cloth impregnated with a trimethyl siloxy silicate, an emulsifier and water. The dry wash and wash formulation of the present invention does not require the use of trimethyl siloxy silicate or a wiping cloth for treating the non-porous surface. Each of the foregoing references shows that there are limitations of the prior art washes and waxes for automotive surfaces these formulations do not meet all of the needs of a desirable wash and wax formulation.

Although most people wish to keep their automobiles clean and shiny, they do not want to spend an inordinate amount of time washing and waxing or polishing their automobiles. Thus, it is continually desirable to develop new compositions capable of simultaneously washing and waxing automotive exterior surfaces. It is also desirable to provide washing and waxing compositions which are substantially free of volatile organic compounds, like mineral spirits. Therefore, there is an existing need for a dry wash and wax formulation for automotive surfaces which may be easily applied and does not require the additional steps of rinsing or buffing.

SUMMARY OF THE INVENTION

One aspect of the present invention is directed to a multifunctional composition formulated for simultaneously cleaning and waxing non-porous surfaces, including but not limited to, exterior surfaces of automobiles and other vehicles, windows, and the like. The composition exhibits waterless washing ability in that it can clean automotive exterior surfaces and other non-porous surfaces without the need for rinsing the treated surface with water. In addition, the composition of this invention is free or substantially free of volatile organic compounds. The composition of this invention is a sprayable water-based composition comprising by weight:

(a) from about 0.04 to about 0.12% of a hydrophobically modified acrylic-based polymer, (b) from about 0.5 to about 5.0% of a silicone blend comprising:

(1) from about 70 to about 95% of a first polydiorganosiloxane fluid having a viscosity of from about 0.65 to about 60,000 centistokes (cSt) at 25° C., and (2) from about 5 to about 30% of a polydiorganosiloxane fluid mixture having a viscosity of from about 500 to about 2000 cSt at 25° C., the polydiorganosiloxane fluid mixture comprising (i) a second polydiorganosiloxane fluid having a viscosity of from about 350 to about 12,500 cSt at 25° C., and (ii) a silicone resin;

(c) from about 0.5 to about 3.5% by weight of a wax; and (d) at least 80% by weight of water.

In one embodiment of the invention, component (a) of the composition of this invention is a hydrophobically modified cross-linked polyacrylate polymer which has been crosslinked with a polyalkenyl polyether.

In another embodiment of the invention, the composition of this invention includes from about 0.04 to about 0.12% by weight, more preferably from about 0.04 to about 0.08% by weight, and most preferably about 0.06% by weight, of component (a).

Component (b)(1) (i.e., the "first" polydiorganosiloxane fluid) of the composition of this invention is a polydimethylsiloxane fluid having a viscosity of from about 350 to about 1000 cSt at 25° C., more preferably a viscosity of about 400 to about 600 cSt at 25° C.

Component (b)(2) (i.e., the polydiorganosiloxane fluid mixture) preferably has a viscosity of from about 500 to about 1000 cSt at 25° C., most preferably a viscosity of about 600 to about 800 cSt at 25° C.

Component (b)(2)(i) (i.e., the "second" polydiorganosiloxane fluid) is preferably a polydimethylsiloxane having a viscosity of from about 350 cSt to about 12,500 cSt, more preferably from about 350 cSt to about 1000 cSt, most preferably about 400 to about 600 cSt, at 25° C.

In one embodiment, component (b)(2)(ii) (i.e., the silicone resin) is a methylated silica resin, preferably a trimethylated silica.

The composition of this invention preferably includes from about 0.5 to about 5.0% by weight, more preferably from about 0.5 to about 2.0% by weight, and most preferably about 0.75 to about 1% by weight, of component (b).

Component (b) preferably comprises from about 70 to about 95% by weight of component (b)(1), i.e., the first polydiorganosiloxane fluid, and from about 5 to about 30% by weight of component (b)(2), i.e., the polydiorganosiloxane fluid mixture. More preferably, component (b) comprises from about 85% to about 95% by weight of component (b)(1) and from about 5% to about 15% by weight of component (b)(2). Most preferably, component (b) comprises about 90 to about 95% by weight of component (b)(1) and about 5 to about 10% by weight of component (b)(2).

Component (b)(2), i.e., the polydiorganosiloxane fluid mixture, preferably comprises from about 60% to about 90% by weight of component (b)(2)(i) (i.e., the "second polydiorganosiloxane") and from about 10% to about 40% by weight of component (b)(2)(ii) (i.e., the silicone resin), more preferably from about 65% to about 85% by weight of component (b)(2)(i) and from about 15% to about 35% by weight of component (b)(2)(ii), and most preferably about 65 to about 75% by weight of component (b)(2)(i) and about 25 to about 35% by weight of component (b)(2)(ii).

In one embodiment, component (c) of the composition of this invention is a wax, prefe carnauba wax.

In another embodiment, component (d) of the composition of this invention is water, preferably deionized water.

The composition of this invention may optionally contain additional components such as UV absorbers, solvents, fragrances, colorants, preservatives, thickening agents, neutralizing agents and stabilizing agents.

The composition of this invention exhibits equal or better performance than leading commercial paste and liquid waxes in the areas of shine, color enhancement and durability.

In one exemplary embodiment, the composition can be equipped with an aerosol spray nozzle that sprays the composition like shaving cream. The sprayed composition is white and foamy, clings to vertical surfaces, and demonstrates high gloss and color enhancement.

A second aspect of this invention is directed to a method of using the composition of the invention to simultaneously clean and wax non-porous surfaces, particularly automotive exterior surfaces (e.g., automotive paint surfaces). The method involves:

(1) applying the composition to a non-porous surface; and (2) wiping the surface onto which the composition has been applied until the surface is dry and shiny, thereby removing soil particles disposed on the surface and leaving a protective wax film on the surface;

wherein the method is carried out in the absence of any water other than the water present in the composition applied to the automotive exterior surface.

The composition of this invention can be used to clean and wax not only automotive exterior surfaces but any non-porous surface, including, but not limited to, metals, plastics, Plexiglass, fiberglass, glass, enamel, tiles, and the like.

DETAILED DESCRIPTION OF THE INVENTION

The present invention provides a composition and method for simultaneously washing and waxing non-porous surfaces, preferably exterior surfaces of automobiles and other vehicles.

Products for waxing or washing and waxing vehicles are described, e.g., in U.S. Pat. No. 6,506,715 to Schultz et al.; U.S. Pat. No. 5,968,238 to Healy et al.; U.S. Pat. No. 6,159,551 to Yeiser et al.; U.S. Pat. No. 7,067,573 to Serobian; U.S. Pat. No. 6,090,767 to Jackson et al.; U.S. Pat. No. 6,475,934 to Nonaka et al.; U.S. Pat. No. 6,309,984 to Nonaka et al.; U.S. Patent Application Publication No. 2005-0250668 to Serobian et al.; JP10204382 to Toshiro; and JP11080668 to Kiyohiro et al. Each of the foregoing references is hereby incorporated by reference herein in their entirety.

As used herein, the term "exterior surfaces of automobiles and other vehicles" is meant to be interpreted broadly and includes an automobile or other vehicle body, trim, wheels, wheelovers, and tires. Vehicles other than automobiles include, e.g., motorcycles, bicycles and trucks. In addition, the surface to be treated in accordance with the present invention can be that of a stationary article having a shiny painted surface. The surface to be treated may be clean, dirty, new or moderately oxidized and may be cool or hot.

As mentioned previously, the composition of this invention is free of or substantially free of volatile organic compounds. As used herein, the term "substantially fee of volatile organic compounds" means that there is less than about 5% volatile organic compounds. Volatile organic compounds may be present as a component of the silicones, depending upon the source of the silicones. In addition, a small amount of volatile organic compounds, less than 5%, may be present as a propellant in an embodiment of the invention where an aerosol sprayer is employed.

Acrylic-Based Polymer

Polymers with a thickening effect which modify the rheology of the composition are also used with advantage in low-water or substantially water-free systems. Such polymers may also be used to increase the surface substantivity of the composition and increase the hydrophobicty of the treated surface. These polymers may be, are preferably, hydrophobically modified acrylate-based polymers, some of which may have relatively high molecular weights of >1,000,000 g/mol. They are used in quantities of 0.01 to 2% by weight, for example in quantities of 0.04 to 0.12% by weight, in dry wash and wax formulations of the present invention.

Suitable products are, for example, the products marketed by Rohm & Haas under the name of Acusol®, which are predominantly polyacrylates with different degrees of alkylation or crosslinking or hydrophobicized nonionic polyols, or the products marketed by B. F. Goodrich under the name of Carbopol®, which are polyacrylates or copolymers of acrylic acid and alkylated (preferably C 5-C10-alkylated) acrylic acids, or the products marketed by B. F. Goodrich under the name of Pemulen®, which are high molecular weight acrylic acid copolymers of the acrylate/C10-C30 alkyl acrylate crospolymer type. A more detailed description of the types of hydrophobically modified polycarboxylic acids which may be used in this invention, including the process for making the same, may be found in U.S. Pat. No. 5,232,622, the disclosure of which is incorporated herein by reference.

Component (a) of the composition of this invention is a hydrophobically modified acrylic-based polymer. In one embodiment, the acrylic based polymer is a polyacrylate powder which has been crosslinked with a polyalkenyl polyether or is an acrylic polymer containing acid groups and which dissolves and swells immediately when neutralized with an alkali salt. An example of a hydrophobically modified cross-linked polyacrylate powder which can be used in the present invention is commercially available from Lubrizol Advanced Materials, Inc. (formerly Noveon, Inc.) (Cleveland, Ohio) under the designation Carbopol® EZ-3. Carbopol® EZ-3 is a hydrophobically modified, crosslinked polyacrylate powder having a pH in water of 2.5.-3.5 and which has been crosslinked with a polyalkenyl polyether.

An example of another preferred acrylic-based polymer for use in this invention is commercially available from Rohm and Haas (Philadelphia, Pennsylvania) under the designation Acusol™ 820. The Acusol™ 820 product is a water emulsion of acrylic polymer containing acid groups, wherein the acrylic polymer will dissolve and swell neutralized with an alkali salt. The emulsion is milky-white and has a density of 8.75 lb/gas, a pH of about 2.7-3.0, and a non-volatile solids content of about 30% by weight.

The composition of this invention preferably includes from about 0.04 to about 0.12% by weight, more preferably from about 0.04 to about 0.08% by weight, and most preferably about 0.06% by weight, of the acrylic-based polymer (component (a)).

Silicone Blend

Suitable silicone compounds include but are not limited to, polydimethylsiloxane, Polydiethylsiloxane, and polymethylphenylsiloxane. Polydimethylsiloxane, which is also known as dimethicone, is suitable and readily available in many forms and grades, including for example, edible grades suitable for use in compositions for food contact usage. The polyalkylsiloxanes that can be used include, for example, polydimethylsiloxanes. These silicone compounds are available, for example, from the General Electric Company in their Viscasil® and SF 96 series, and from Dow Corning in their Dow Corning 200 series. In one embodiment of the invention, the "first" polydiorganosiloxane fluid for use in the present invention, is a polydimethylsiloxane which has a viscosity of about 500 cSt at 25° C. Such a polydimethylsiloxane fluid is commercially available, e.g., from Dow Corning under the tradename "DC-200 Fluid". In another embodiment of the invention, the "second" polydiorganosiloxane fluid for use in the present invention, is also polydimethylsiloxane which has a viscosity of about 300-1000 cSt at 25° C. In one embodiment, the "second" polydiorganosiloxane is mixed with a high molecular weight silicone resin to form a polydimethylsilxoane mixture which has a viscosity of 700 cSt at 25° C. Such polydimethyl silxoane mixture is commercially available,e.g. from Dow Corning under the trademame "DC 2-1912 Fluid."

Other suitable polydiorganosiloxanes include, polyalkylaryl siloxane fluids containing one or more alkyl or alkylaryl substituents, and include, but are not limited to polymethylphenylsiloxanes, poly[(dimethylsiloxane)/(methylvinylsiloxane)], poly[(dimethylsiloxane)/(diphenylsiloxane)], poly[(dimethylsiloxane)/(phenylmethylsiloxane)], and poly[(dimethylsiloxane)/(diphenylsiloxane)/(methylvinylsiloxane)]. These siloxanes are available, for example, from the General Electric Company as SF 1075 methyl phenyl fluid or from Dow Corning as 556 Cosmetic Grade Fluid, Rhodorsil 763 from Rhône-Poulenc, Silbione 70641 V 30 and 70641 V 200 from Rhône-Poulenc, the silicones of the PK series from Bayer, such as PK20, the silicones of the PN and PH series from Bayer, such as PN 1000 and PH 1000, and certain oils of the SF series from General Electric, such as SF 1250, SF 1265, SF 1154 and SF 1023.

Higher molecular weight silicones, including silicone gums and resins, may be used in accordance with the present invention and include polydiorganosiloxanes with a molecular mass of between 200,000 and 5,000,000, used alone or as a mixture in a solvent chosen from volatile silicones, polydimethylsiloxane (PDMS) oils, polyphenylmethylsiloxane (PPMS) oils, isoparaffins, methylene chloride, pentane, dodecane, tridecane and tetradecane, or mixtures thereof. The silicones can be linear or branched, and can be modified by chemical groups to provide additional properties.

Component (b) of the composition of this invention is a silicone blend containing (1) a first polydiorganosiloxane fluid having a viscosity of from about 0.65 to about 60,000 centistokes at 25° C., and (2) a polydiorganosiloxane fluid mixture having a viscosity of from about 600 to about 800 centistokes at 25° C. The polydiorganosiloxane fluid mixture contains (i) a second polydiorganosiloxane fluid and (ii) a silicone resin.

The first and second polydiorganosiloxane fluids (i.e., components (b)(1) and (b)(2)(i)) are preferably independently selected from the group consisting of silicone oils having the general formula:

$$(RnSiO_{((4-n)/2)})m,$$

wherein n is between 0 and 3, m is 2 or greater, and R is selected from the group consisting of alkyl, alkylene, allyl, aryl, benzyl, phenyl, amine, amide, vinyl, fluoroalkyl, perfluoroalkane, carboxyester and quaternary alkyl ammonium radicals, and mixtures thereof.

Suitable polydiorganosiloxane fluids for use as the first and second polydiorganosiloxane fluids in the present invention include, but are not limited to., polydimethylsiloxane, polydiethylsiloxane, polymethylphenylsiloxane, polyalkylarylsiloxane, polyethylene-oxydialkylsiloxane, polypropyleneoxydialkylsiloxane, polydialkylcyclosiloxane and mixtures thereof. In one embodiment of the present invention, the first and second polydiorganosiloxane fluids are each a polydimethylsiloxane fluid.

Component (b)(1) (i.e., the "first" polydiorganosiloxane fluid) of the composition of this invention is preferably a polydimethylsiloxane fluid having a viscosity of from about 350 to about 1000 cSt at 25° C., more preferably a viscosity of about 400 to about 600 cSt at 25° C.

An example of a suitable polydiorganosiloxane fluid for use as component (b)(1) in the present invention is commercially available from Dow Corning under the designation "Dow Corning 200® Fluid, 500 cSt", which is a polydimethylsiloxane (100% active) having a viscosity of 500 cSt at 25° C.

Component (b)(2)(i) (i.e., the "second" polydiorganosiloxane fluid) is preferably a polydimethylsiloxane having a viscosity of from about 350 cSt to about 12,500 cSt, more preferably from about 350 cSt to about 1000 cSt.

Component (b)(2)(ii) is a silicone resin. Examples of suitable silicone resins include those containing triorganosilyl units and $SiO_{4/2}$ units. Preferably, the silicone resin is trimethylated silica.

Component (b)(2) (i.e., the polydiorganosiloxane fluid mixture) preferably has a viscosity of from about 500 to about 1000 cSt at 25° C., more preferably a viscosity of about 700 cSt at 25° C.

An example of a suitable polydiorganosiloxane fluid mixture for use as component (b)(2) in the present invention is commercially available from Dow Corning under the designation "Dow Corning® 2-1912 Fluid". Dow Corning® 2-1912 Fluid is a transparent, two-component, viscous blend of polydimethylsiloxane and a high molecular weight silicone resin and has a viscosity of 700 cSt at 25° C. Dow Corning® 2-1912 Fluid contains more than 60% by weight of polydimethylsiloxane and from 30 to 60% by weight of trimethylated silica.

In one embodiment, the silicone blend comprises from about 70 to about 95% by weight of the first polydiorganosiloxane fluid and from about 5 to about 30% by weight of the polydiorganosiloxane fluid mixture. More preferably, the silicone blend comprises from about 85% to about 95% by weight of the first polydiorganosiloxane fluid and from about 5% to about 15% by weight of the polydiorganosiloxane fluid mixture. Most preferably, the silicone blend comprises about 85 to about 90% by weight of the first polydiorganosiloxane and about 10 to about 15% by weight of the polydiorganosiloxane fluid mixture.

The composition of this invention contains component (b) (i.e., the silicone blend) at a level preferably ranging from about 0.5 to about 5.0% by weight, and more preferably ranging from 0.5 to about 2.0% by weight of the composition. Most preferably, the composition contains about 0.95% by weight of the silicone blend.

Component (c) in the composition of this invention is a wax. Waxes suitable for use in the composition of this invention include vegetable waxes such as carnauba, candelilla, and ouricury; mineral waxes such as montan, paraffin, and microcrystalline waxes; animal waxes such as beeswax; and synthetic waxes such as amide waxes and silicone waxes. Combinations of two or more of the aforementioned waxes can also be used in the composition of the present invention.

In one embodiment, the wax for use in this invention is carnauba wax.

The wax is present in the composition at a level of preferably from about 0.5 to about 3.5%, more preferably from about 1.6 to about 3.0%, and most preferably about 1.80 to about 2.0%, by weight of the composition.

Component (d) in the composition of this invention is water. The water used in the composition of this invention may be deionized, industrial soft water or any suitable grade of water. Preferably, the water used in the composition is deionized or distilled water. The composition of this invention contains water preferably at a level of at least about 80% by weight, more preferably from about 80% to about 98% by weight, and most preferably from about 95 to about 98% by weight.

Adjuncts

The composition of this invention may further contain one or more adjuncts selected from buffering and pH adjusting agents, wetting agents, abrasives, whitening agents, pigments, microbiocides, preservatives and mixtures thereof. These and other suitable additives which can be used in the composition of the present invention are disclosed, e.g., in U.S. Patent Application Publication No. 2005/0250668, which was previously incorporated by reference herein in its entirety.

Wetting Agents

The composition of this invention preferably includes at least one silicone wetting agent which aids in the spreading and leveling of silicone oils onto treated surfaces. Suitable wetting agents are disclosed, for example, in U.S. Patent Application Publication No. 2005/0250668 to Serobian et al., which was previously incorporated by reference herein. Non-limiting examples of suitable wetting agents include, e.g., polyalkyleneoxide-modified polydimethylsiloxane (available from General Electric as Silwet® 7650), polyalkyleneoxide-modified heptamethyltrisiloxane (also available from General Electric as Silwet® 7280 and Silwet® 7608), silicone glycol copolymer surfactant (available from Dow Coming as Dow Coming® 57) and the Dow Coming silicone polyether superwetting agent designated "Dow Coming® Q2-5211". The wetting agent used in the present invention is preferably a silicone polyether wetting agent such as the aforementioned Dow Coming® Q2-5211 wetting agent.

The wetting agent is preferably used at a level of from about 0.1 to 1.0%, more preferably from about 0.2 to about 0.6%, and most preferably about 0.4 to about 0.6%, by weight of the composition of this invention.

Buffers and pH Adjusters

Suitable buffering and pH adjusting agents which can be used in the present invention include, but are not limited to, organic acids, mineral acids, alkali metal and alkaline earth salts of silicate, metasilicate, polysilicate, borate, hydroxide, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2-methylpropanol. Exemplary buffering agents for compositions of this invention are nitrogen-containing materials. Some examples are amino acids such as lysine or lower alcohol amines like mono-, di-, and tri-ethanolamine. Other exemplary nitrogen-containing buffering agents are tri(hydroxymethyl)amino methane (TRIS), 2-amino-2-ethyl-1,3-propanedi-ol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine(bicine) and N-tris(hydroxymethyl)-methyl glycine(tricine), morpholine and morpholine derivatives. Other suitable buffers include ammonium carbamate, citric acid, acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. Additional buffers are disclosed in WO 95/07971, which is incorporated herein by reference. Other suitable pH adjusting agents include sodium or potassium hydroxide. Alternatively, an alkalizing agent may be used that exhibits or combines one or more of the desired properties of the class of materials known in the art as pH adjusters, alkalis, base, alkalinity agents, builders and buffers. For example, the composition of this invention may include a builder that serves as an alkalizer or pH adjusting agent effective at controlling the composition pH as well as providing builder functionality to the inventive composition during use is selected. In another embodiment of the invention, a buffer may be employed that serves to at least partially neutralize a polymer during the preparation stage of the compositions, and further serves to control the pH of the inventive composition over long storage times.

In one embodiment of the invention, a preferred pH adjusting agent for use in the present invention is triethanolamine.

The pH adjusting agent is present in the composition of this invention at a level sufficient to provide the composition with a pH of from about 5.0 to about 8.0, and more preferably from about 6.0 to about 7.0. Generally, the pH adjusting agent is present preferably at a level of from about 0.010 to about 0.10%, more preferably from about 0.050 to about 0.090%, and most preferably about 0.060 to about 0.080%, by weight of the composition.

Abrasives and Whiteners

The composition of this invention preferably includes an abrasive and/or a whitener. Conventional abrasive and/or whitening agents may be used. Titanium dioxide, which functions as both an abrasive and a whitener, is preferred. Kaolin clay or aluminum oxide may also be used. Preferably, the abrasive and/or whitener is present in the composition of this invention at a level of from about 0.1 to about 4.5%, more preferably from about 0.02 to about 0.06%, and most preferably about 0.025 to about 0.050%, by weight of the composition.

Preservatives

Preservatives and microbicides which can be used in the composition of the present invention include, but are not limited to, fungicides, bateriacides, mildewcides, and the like.

An example of a suitable preservative which can be used in the present invention is Dantoguard Plus™ (dimethylol-5,5-dimethylhydantoin), commercially available from Lonza (Fairfield, N.J., USA).

The preservative can be present in the composition of this invention preferably at a level of from about 0.1 to about 0.2%, more preferably from about 0.1 to about 0.15%, and most preferably about 0.10%, by weight of the composition.

Aerosol Applications

It may be desirable to use the composition of the present invention in the form of an aerosol, particularly in a pressurized aerosol container employing a compressed gas or fluid to serve as a propellant system. Suitable propellants included compressible gases, including but not limited to air, nitrogen, argon, helium, carbon dioxide, nitrous oxide, and mixtures thereof. Suitable propellants include those standard aerosols known in the art as "LPG" or "liquid petroleum gas" propellants. Examples include, but are not limited to those commonly designated as LPG A-46, LPG A-70, LPG A-108 and their mixtures and combinations with other aerosols. LPG consists of high purity hydrocarbons derived directly from oil wells, and as a by-product from the petroleum industry, consisting essentially of a mixture of propane, isobutane and n-butane.

Other common volatile organic compounds, and their derivatives may suitably be employed, including dialkyl ethers, such as dimethyl ether and diethyl ether and the petroleum ethers. Volatile organic compounds may also be suitably employed as propellants, include the alkane series from methane, propane, butane, pentane and hexane and all of their respective isomers, and mixtures thereof, alone and in combinations thereof. Propellants offering improved safety in terms of reduced or non-flammability are also suitable, and include such liquid propellants as those based on chlorofluorocarbons, even though it is realized that the chlorofluorocarbons are no longer generally used due to environmental considerations. Suitable alternatives, believed to be less harmful to the earth's environment and ozone layer, include non-halogenated and partially halogenated materials, such as hydrofluorocarbons (HFC), hydrofluoroalkanes (HFA) and hydrochloroalkanes (HCA) and hydrochlorofluorocarbons (HCFC). Some examples include but are not limited to HFC-125, HFC-134a, HFC-152a, HFC-227ea, HFC-245fa and HCFC-22.

Also suitable are aerosol propellants approved by SNAP, under the United States Environmental Protection Agency (US-EPA) Significant New Alternatives Policy (detailed in Section 612 of the Clean Air Act), which includes oxygenated organic solvents (esters, ethers, alcohols) chlorinated solvents (trichloroethylene, perchloroethylene, methylene chloride), trans-1,2-dichloroethylene, hydrofluoroether (HFE) 7100 and HFE 7200, monochlorotoluenes and benzotrifluorides, (subject to a 50 ppm workplace standard for monochlorotoluenes and a 100 ppm standard for benzotrifluoride), HFC-4310mee (subject to a 200 ppm time-weighted average workplace exposure standard and 400 ppm workplace exposure ceiling HFC-365mfc), HCFC-225ca/cb, perfluorocarbons (PFCs) and perfluoropolyethers (PFPEs) (subject to need with no reasonable alternatives found sufficient for intended end use applications), HCFC-141b, terpenes, C5-C20 petroleum hydrocarbons, and HFC-245fa.

When an aerosol formulation is employed, one or more corrosion inhibitors known in the art are included in the formulations to protect metal portions of the pressurized system, including the can, valve, valve spring, nozzle and components of the aerosol package and dispenser assembly.

In suitable embodiments, the propellant comprises 1% by weight to about 90% by weight, or 2% by weight to about 80% by weight, or alternatively 5% by weight to about 70% by weight of the inventive composition.

Method of Making

The composition of this invention can be made according to conventional methods of preparing aqueous dispersions of silicone oils. Reference is made hereby to U.S. Patent Application Publication No. 2005/0250668 to Serobian, which was previously incorporated by reference herein in its entirety. Concentrated as well as dilute dispersions of the composition can be formed. Glycols such as propylene glycol, ethylene glycol, or low molecular weight polyols such as glycerine, etc., may be added during the initial dispersion preparation to ensure a stable, readily dispersible concentrate.

Method of Using and Application

A second aspect of this invention is directed to a method of using the composition of the invention to simultaneously clean and wax non-porous surfaces, particularly automotive exterior surfaces (e.g., automotive paint surfaces). The method involves:

(1) applying the composition to an automotive exterior surface; and (2) wiping the surface onto which the composition has been applied until the surface is dry and shiny, thereby removing soil particles disposed on the surface and leaving a protective wax film on the surface;

wherein the method is carried out in the absence of any water other than the water present in the composition applied to the automotive exterior surface.

The composition of this invention can be used to clean and wax not only automotive exterior surfaces but any non-porous surface, including, but not limited to, metals, plastics, Plexiglass, fiberglass, glass, enamel, tiles, and the like.

In one embodiment of the method of this invention, the composition is applied by spraying onto the surface. Spraying can be accomplished using, e.g., a hand pump or aerosol.

Although spraying the composition onto the surface is the preferred method of application, the composition of this invention may be applied to the target surface by a variety of means, including via a wash, dip or immersion process. The composition may be applied by means of a carrier, including but not limited to, an impregnated wipe, foam, sponge, cloth, towel, tissue or paper towel or similar releasably absorbent carrier that enables the inventive composition to be applied by direct physical contact and transferred from the carrier to the target surface, generally during a spreading, padding, rubbing or wiping operation. Combinations of a direct application, like spraying, followed by a spreading, padding, rubbing or wiping operation performed with the aid of a foam, sponge, cloth, towel, tissue or paper towel, squeegee or similar wiping implement is also suitable for applying the composition of the present invention.

In one embodiment, the composition of the present invention is sprayed directly onto the target surface and therefore are typically packaged in a spray dispenser. The spray dispenser can be any of the manually activated means for producing a spray of liquid droplets as is known in the art, e.g. trigger-type, pump-type, electrical spray, hydraulic nozzle, sonic nebulizer, high pressure fog nozzle, non-aerosol self-pressurized, and aerosol-type spray means. Automatic activated means can also be used herein. These type of automatic means are similar to manually activated means with the exception that the propellant is replaced by a compressor.

The spray dispenser can be an aerosol dispenser. Said aerosol dispenser comprises a container which can be constructed of any of the conventional materials employed in fabricating aerosol containers. The dispenser must be capable of withstanding internal pressure in the range of from about 5 to about 120 p.s.i.g. (pounds per square inch gas), more preferably from about 10 to about 100 p.s.i.g. The one important requirement concerning the dispenser is that it be provided with a valve member which will permit the inventive composition contained in the dispenser to be dispensed in the form of a spray of fine, or finely divided, particles or droplets. The aerosol dispenser utilizes a pressurized sealed container from which the inventive composition is dispensed through a special actuator/valve assembly under pressure. The aerosol dispenser is pressurized by incorporating therein a gaseous component generally known as a propellant. A more complete description of commercially available aerosol-spray dispensers appears in U.S. Pat. No. 3,436,772, Stebbins; and U.S. Pat. No. 3,600,325, Kaufman et al.; both of which are incorporated herein by reference.

Alternatively the spray dispenser can be a self-pressurized non-aerosol container having a convoluted liner and an elastomeric sleeve. Said self-pressurized dispenser comprises a liner/sleeve assembly containing a thin, flexible radially expandable convoluted plastic liner of from about 0.010 to about 0.020 inch thick, inside an essentially cylindrical elastomeric sleeve. The liner/sleeve is capable of holding a substantial quantity of the inventive composition and of causing said product to be dispensed. A more complete description of self-pressurized spray dispensers can be found in U.S. Pat. No. 5,111,971, Winer, and U.S. Pat. No. 5,232,126, Winer; both of which are herein incorporated by reference.

Another type of aerosol spray dispenser is one wherein a barrier separates the inventive composition from the propellant (preferably compressed air or nitrogen), as is disclosed in U.S. Pat. No. 4,260,110, incorporated herein by reference. Such a dispenser is available from EP Spray Systems, East Hanover, N.J.

In one embodiment, the spray dispenser is a non-aerosol, manually activated, pump-spray dispenser. Said pump-spray dispenser comprises a container and a pump mechanism which securely screws or snaps onto the container. The container comprises a vessel for containing the inventive composition to be dispensed. The pump mechanism comprises a pump chamber of substantially fixed volume, having an opening at the inner end thereof. Within the pump chamber is located a pump stem having a piston on the end thereof disposed for reciprocal motion in the pump chamber. The pump stem has a passageway there through with a dispensing outlet at the outer end of the passageway and an axial inlet port located inwardly thereof.

The container and the pump mechanism can be constructed of any conventional material employed in fabricating pump-spray dispensers, including, but not limited to: polyethylene; polypropylene; polyethyleneterephthalate; blends of polyethylene, vinyl acetate, and rubber elastomer. Other materials can include stainless steel. A more complete disclosure of commercially available dispensing devices appears in: U.S. Pat. No. 4,895,279, Schultz; U.S. Pat. No. 4,735,347, Schultz et al.; and U.S. Pat. No. 4,274,560, Carter; all of said references are herein incorporated by reference.

Most preferably, the spray dispenser is a manually activated trigger-spray dispenser. Said trigger-spray dispenser comprises a container and a trigger both of which can be constructed of any of the conventional material employed in fabricating trigger-spray dispensers, including, but not limited to: polyethylene; polypropylene; polyacetal; polycarbonate; polyethylene-terephthalate; polyvinyl chloride; polystyrene; blends of polyethylene, vinyl acetate, and rubber elastomer. Other materials can include stainless steel and glass. The trigger-spray dispenser does not incorporate a propellant gas.

In one embodiment using a trigger-spray dispenser the composition is free or essentially free of volatile organic solvents. The trigger-spray dispenser herein is typically one which acts upon a discrete amount of the inventive composition itself, typically by means of a piston or a collapsing bellows that displaces the composition through a nozzle to create a spray of thin liquid. Said trigger-spray dispenser typically comprises a pump chamber having either a piston or bellows which is movable through a limited stroke response to the trigger for varying the volume of said pump chamber. This pump chamber or bellows chamber collects and holds the product for dispensing. The trigger spray dispenser typically has an outlet check valve for blocking communication and flow of fluid through the nozzle and is responsive to the pressure inside the chamber. For the piston type trigger sprayers, as the trigger is compressed, it acts on the fluid in the chamber and the spring, increasing the pressure on the fluid. For the bellows spray dispenser, as the bellows is compressed, the pressure increases on the fluid. The increase in fluid pressure in either trigger spray dispenser acts to open the top outlet check valve. The top valve allows the product to be forced through the swirl chamber and out the nozzle to form a discharge pattern. An adjustable nozzle cap can be used to vary the pattern of the fluid dispensed. For the piston spray dispenser, as the trigger is released, the spring acts on the piston to return it to its original position. For the bellows spray dispenser, the bellows acts as the spring to return to its original position. This action causes a vacuum in the chamber. The responding fluid acts to close the outlet valve while opening the inlet valve drawing product up to the chamber from the reservoir.

A more complete disclosure of commercially available dispensing devices appears in U.S. Pat. No. 4,082,223, Nozawa; U.S. Pat. No. 4,161,288, McKinney; U.S. Pat. No. 4,434,917, Saito et al.; U.S. Pat. No. 4,819,835, Tasaki; and U.S. Pat. No. 5,303,867, Peterson; all of said references are incorporated herein by reference. A broad array of trigger sprayers or finger pump sprayers are suitable for use with the compositions of this invention. These are readily available from suppliers such as Calmar, Inc., City of Industry, Calif.; CSI (Continental Sprayers, Inc.), St. Peters, Mo.; Berry Plastics Corp., Evansville, Ind.; or Seaquest Dispensing, Cary, Ill.

The present invention and benefits of using the aqueous dispersion of this invention are more particularly described in the following examples and claims.

EXPERIMENTAL

EXAMPLE 1

In Example 1, a wash and wax composition within the scope of the present invention was prepared having the formulation set forth in Table I below:

TABLE I

Example 1: Formulation

| Ingredient | Weight Percent |
|---|---|
| Carbopol ® EZ-3[1] | 0.060 |
| Silicone Blend[2] | 0.95 |
| Carnauba Wax (22%) | 1.80 |
| Deionized Water | 96.58 |
| $TiO_2$ | 0.040 |
| Dantoguard Plus[3] | 0.10 |
| Triethanolamine (99%) | 0.070 |
| Q2-5211[4] | 0.40 |
| TOTAL | 100.00 |

[1]A hydrophobically modified cross-linked polyacrylate powder commercially available from Lubrizol Advanced Materials, Inc. (formerly Noveon, Inc.) (Cleveland, Ohio).
[2]A silicone blend containing 90.00% by weight of Dow Corning ® 200 Fluid, 500 cSt and 10.00% by weight of Dow Corning ® 2-1912 Fluid.
[3]A preservative, specifically dimethylol-5,5-dimethylhydantoin), commercially available from Lonza (Fairfield, N.J., USA).
[4]A low molecular weight nonionic silicone polyether wetting agent, commercially available from Dow Corning.

EXAMPLE 2 AND COMPARATIVE EXAMPLES A-D

In Example 2, the gloss performance of the invention composition prepared in Example 1 was measured. In Comparative Examples A-C, the gloss performances of three commercially available liquid waxes, specifically Nu Finish, Meguiars Cleaner Wax and Meguiars Gold Class, respectively, were measured. In Comparative Example D, no liquid wax was used leaving the surface untreated.

Four black painted automotive 12"×18" panels (Panel Nos. 1-4) were each subdivided into three sections. Each section was either treated with a particular liquid wax or left untreated, as indicated in Tables II-V below. In Example 2, 0.47 grams of the Example 1 composition was sprayed onto the applicable panel sections, using faucet water. In Examples A-C, 0.47 grams of the Nu Finish, Meguiars Cleaner Wax and Meguiars Gold Class liquid waxes were respectively applied to applicable panel sections, without using additional water. The panel section surfaces were then buffed until dry and shiny. In Example D, the applicable panel sections were left untreated. The experiments in Example 2 and Comparative Examples A-D were repeated six times. The black panels used in Example 2 and Comparative Examples A-D were identical.

The gloss of each treated and untreated panel section surface was then measured at a 20° angle using a Byk glossmeter. The results are presented in Tables II-V below. Because each experiment was repeated six times, the results shown in the tables below represent the "mean value" of the six measurements, with the mean standard deviation ("Std. Dev.") being shown in parenthesis. In the tables below, "NU" refers to Nu Finish liquid wax, "MCW" refers to Meguiars Cleaner Wax, and "MGC" refers to Meguiars Gold Class.

TABLE II

Panel No. 1: Gloss Performance

| Panel No. 1 | Liquid Wax | Gloss Mean Value (Std. Dev.) |
|---|---|---|
| Section 1 | Example 1 | 77.867 (2.618) |
| Section 2 | NU | 76.300 (1.293) |
| Section 3 | MCW | 77.067 (2.380) |

TABLE III

Panel No. 2: Gloss Performance

| Panel No. 2 | Liquid Wax | Gloss Mean Value (Std. Dev.) |
|---|---|---|
| Section 1 | Untreated | 76.017 (2.035) |
| Section 2 | Example 1 | 79.917 (1.072) |
| Section 3 | NU | 78.600 (2.570) |

TABLE IV

Panel No. 3: Gloss Performance

| Panel No. 3 | Liquid Wax | Gloss Mean Value (Std. Dev.) |
|---|---|---|
| Section 1 | MCW | 79.400 (1.798) |
| Section 2 | Example 1 | 77.867 (1.864) |
| Section 3 | MGC | 77.267 (1.133) |

TABLE V

Panel No. 4: Gloss Performance

| Panel No. 4 | Liquid Wax | Gloss Mean Value (Std. Dev.) |
|---|---|---|
| Section 1 | Example 1 | 77.800 (1.760) |
| Section 2 | MGC | 73.567 (4.195) |
| Section 3 | MCW | 76.750 (3.207) |

The results shown in Tables II-V above indicate that the composition of the present invention provides comparable or better gloss performance than the commercially available liquid waxes tested.

TABLE VI

Example 2: Formulation

| Ingredient | Weight Percent |
|---|---|
| Carbopol ® EZ-3[1] | 0.20 |
| Silicone Blend[2] | 0.95 |
| Carnauba Wax (22%) | 1.98 |
| Deionized Water | 96.08 |
| $TiO_2$ | 0.040 |
| Dantoguard Plus[3] | 0.10 |
| Triethanolamine (99%) | 0.25 |
| Q2-5211[4] | 0.40 |
| TOTAL | 100.00 |

[1]A hydrophobically modified cross-linked polyacrylate powder commercially available from Lubrizol Advanced Materials, Inc. (formerly Noveon, Inc.) (Cleveland, Ohio).
[2]A silicone blend containing 90.00% by weight of Dow Corning ® 200 Fluid, 500 cSt and 10.00% by weight of Dow Corning ® 2-1912 Fluid.
[3]A preservative, specifically dimethylol-5,5-dimethylhydantoin), commercially available from Lonza (Fairfield, N.J., USA).
[4]A low molecular weight nonionic silicone polyether wetting agent, commercially available from Dow Corning.

TABLE VII

Contact Angle

| Wax Sample | Contact Angle Untreated | Contact Angle Treated |
|---|---|---|
| Example 2/Rep. 1 | 78.0 (3.22 std. dev.) | 102.7 (12.17 std. dev) |
| Example 2/Rep. 2 | 78.6 (9.93 std. dev.) | 102.9 (8.62 std. dev) |
| Example 2/Rep. 3 | 76.4 (6.22 std. dev.) | 103.1 (7.09 std. dev) |
| Soft 99/Rep 1 | 78.3 (8.61 std. dev.) | 104.2 (6.44 std. dev.) |
| Soft 99/Rep 2 | 78.1 (8.36 std. dev.) | 104.0 (5.80 std. dev.) |
| Soft 99/Rep 3 | 77.9 (8.06 std. dev.) | 104.3 (5.45 std. dev.) |

In Table VI, Example 2 Formulation differs from Example 1, in Table I, because it has higher percentages of Carbopol EZ-3 and Carauba Wax which give it a more of a gel consistency which is more comparable to a paste wax product. Example 2 has a viscosity of 8358 cts at 23° C. and a pH of 7.16. It exhibits excellent spreadablity on a surface and imparts good hydrophobicity to a treated surface. To show how Example 2 compares with a high performance paste wax, the contact angle of the Example 2 Formulation as applied to a surface was tested and compared with that of the Soft 99 Paste Wax formulation which is commercially available from Soft 99, a Japanese company.

In Table VII, the contact angle testing was performed by putting three replicate drops of the Example 2 Formula and three replicate drops of the Soft 99 paste wax (a Japanese product) on a black panel. The black automotive panels used for the testing were 4"×16" Ford F-Series. The contact angle was measured using a Kruss Contact Angle Measurement Instrument (DSA-V1). The contact angle was measured using a needle size of 0.49 mm, at a magnification of 70.0, and using deionized water.

The method of applying Example 2 formula to the panel was to put 1.00 gram of water from the faucet onto the surface of the panel, then apply 0.35 grams of the Example 2 formulation onto the panel surface and then buff the surface until it is clear and shiny. The method of applying the Soft 99 wax to the panel surface was to add 0.35 grams onto the surface and then buff the surface until it is clear and shiny.

The results of the contact angle testing show that the panels treated with Soft 99 wax were on the average about 1.5 to about 2.00 higher on the contact angle measurement than the panels treated with Example 2. The panels treated with Soft 99 paste wax showed an increased contact angle on average of about 26 degrees from the base untreated panel. The panels treated with Example 2 showed an increased contact angle on average of about 25.3 degrees when compared with the based untreated panel. Overall, the contact angle test data shows that Example 2 which has more of a gel consistency performs comparably to a high performance paste wax, like Soft 99. Although the contact angle of panels treated with Soft 99 paste wax was slightly higher than that of panels treated with Example 2, the fact that Example 2 is a gel and is easy to spread and apply to a surface will make it more efficient and less labor intensive for consumers to use.

It should be understood that a wide range of changes and modifications can be made to the composition and method of this invention. It is therefore intended that the foregoing description illustrates rather than limits this invention, and that it is the following claims, including all equivalents, which define this invention.

What is claimed is:

1. A water-based composition for simultaneously washing and waxing surfaces, the composition comprising by weight:

(a) from about 0.01 to about 2.0% of an acrylic-based polymer, (b) from about 0.5 to about 5.0% of a silicone blend comprising:

(1) a first polydiorganosiloxane fluid having a viscosity of from about 0.65 to about 60,000 centistokes (cSt) at 25° C., and (2) a polydiorganosiloxane fluid mixture having a viscosity of from about 500 to about 2000 cSt at 25° C., the polydiorganosiloxane fluid mixture comprising (i) a second polydiorganosiloxane fluid and (ii) a silicone resin;

(c) from about 0.5 to about 3.5% by weight of a wax; and (d) at least 80% by weight of water; wherein the composition is substantially free of volatile organic compounds.

2. A composition according to claim 1, wherein the composition has the consistency of a gel.

3. A composition according to claim 1, wherein the composition further comprising a propellant.

4. A composition according to claim 3, wherein the composition further comprising a corrosion inhibitor.

5. A composition according to claim 3, wherein the composition is an aerosol formulation which foams and clings to vertical surfaces upon application.

6. A composition according to claim 1, wherein the silicone blend comprises at least 70% by weight of the first polydiorganosiloxane fluid.

7. A composition according to claim 1, wherein the silicone blend comprises less than 30% by weight of the polydiorganosiloxane fluid mixture.

8. A composition according to claim 1, wherein the silicone blend comprises at least 85% by weight of the first polydiorganosiloxane fluid.

9. A composition according to claim 1, wherein the silicone blend comprises less than 15% by weight of the polydiorganosiloxane fluid mixture.

10. A composition according to claim 1, wherein the composition further comprising about 0.01 to about 1.0% of a wetting agent.

11. A composition according to claim 10, wherein the wetting agent is selected from the group consisting of: polyalkyleneoxide-modified polydimethylsiloxane, polyalkyleneoxide-modified heptamethyltrisiloxane, silicone glycol copolymer, silicone polyether, and any combinations and mixtures thereof.

12. A composition according to claim 1, wherein the pH of the composition is about 5.0 to about 8.0.

13. A sprayable water-based composition for simultaneously washing and waxing a surface, the composition comprising by weight:

(a) from about 0.01 to about 2.0% by weight of an acrylic-based polymer, (b) from about 0.5 to about 2.0% by weight of a polydimethylsiloxane blend comprising:

(i) at least about 85% by weight of a first polydimethylsiloxane fluid having a viscosity of from about 350 to about 1000 centistokes at 25° C., and (ii) less than about 15% by weight of a polydimethylsiloxane fluid mixture having a viscosity of from about 500 to about 1000 centistokes at 25° C., the polydimethylsiloxane fluid mixture comprising a polydimethylsiloxane fluid having a viscosity of from about 350 to about 1000 centistokes at 25° C. and trimethylated silica resin;

(c) at least about 0.5% by weight of wax;

(d) at least about 1% by weight of propellant; and (d) at least about 80% by weight of water; wherein the composition is substantially free of volatile organic compounds.

14. A composition according to claim 13, wherein the composition further comprising one or more adjuncts selected from the group consisting of: pH adjusting agents, wetting agents, abrasives, whitening agents, pigments, microbicides, corrosion inhibitors and any combinations or mixtures thereof.

15. A composition according to claim 13, wherein the composition further comprising a wetting agent is selected from the group consisting of: polyalkyleneoxide-modified polydimethylsiloxane, polyalkyleneoxide-modified heptamethyltrisiloxane, silicone glycol copolymer, silicone polyether, and any combinations and mixtures thereof.

16. A method of simultaneously washing and waxing a surface, comprising the steps of:

(1) applying the composition of claim 1 to said surface; and (2) wiping the surface onto which the composition has been applied until the surface is dry and shiny wherein the method is carried out in the absence of any water other than the water present in the composition.

17. A method according to claim 16, wherein the composition is applied onto the surface using an aerosol sprayer.

18. A method according to claim 16, wherein the composition is applied onto the surface using a manually activated sprayer.

19. A method according to claim 16, wherein the surface is wiped using an absorbent carrier which removes any remaining soils from the surface.

20. A method according to claim 16, wherein said surface is glass.

* * * * *